US012018538B1

(12) United States Patent
Breaux et al.

(10) Patent No.: US 12,018,538 B1
(45) Date of Patent: Jun. 25, 2024

(54) COMPRESSION SLEEVE STRUCTURE FOR MOUNTING MAGNETS IN DOWNHOLE NUCLEAR MAGNETIC RESONANCE APPLICATION

(71) Applicant: Halliburton Energy Services, Inc., Houston, TX (US)

(72) Inventors: Brian Breaux, Houston, TX (US); Boguslaw Wiecek, Kingwood, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/124,863

(22) Filed: Mar. 22, 2023

(51) Int. Cl.
*E21B 23/01* (2006.01)

(52) U.S. Cl.
CPC ..... *E21B 23/01* (2013.01)

(58) Field of Classification Search
CPC ..... E21B 23/01
See application file for complete search history.

(56) References Cited

U.S. PATENT DOCUMENTS 6,008,646 A * 12/1999 Griffin ..... G01V 3/32 324/318
6,666,285 B2 * 12/2003 Jones ..... E21B 47/01 175/325.1
7,669,671 B2 * 3/2010 Hall ..... E21B 17/046 166/242.6
7,683,613 B2 3/2010 Freedman et al.
7,986,145 B2 * 7/2011 Sorbier ..... E21B 47/017 324/333
8,773,134 B2 * 7/2014 Sorbier ..... E21B 47/017 181/102
9,435,193 B2 * 9/2016 Chau ..... E21B 47/06
2002/0057210 A1 5/2002 Frey et al.
2002/0108784 A1 * 8/2002 Kruspe ..... E21B 33/1243 175/50

(Continued)

OTHER PUBLICATIONS

Abstract of Sun, Zhe et al., "Design of a new LWD NMR tool with high mechanical reliability", Journal of Magnetic Resonance; vol. 317, Aug. 2020, 106791.

(Continued)

*Primary Examiner* — Steven A MacDonald
(74) *Attorney, Agent, or Firm* — NOVAK DRUCE CARROLL LLP

(57) ABSTRACT

Aspects of the subject technology relate to securing magnets within a nuclear magnetic resonance ("NMR") tool in a manner that prevents damage or disturbance of the magnets due to the drilling environment, and more particularly, to creating a chamber within the structure of a logging while drilling ("LWD") tool to isolate the magnets from certain external conditions. A downhole tool comprises a tool collar with a recessed portion comprising a collar mandrel section and a threaded segment, wherein the recessed portion of the tool collar comprises at least one cavity configured to accept one or more carriers configured to hold one or more magnets, a compression sleeve covering the recessed portion and the at least one cavity of the downhole tool; and a compression sub component mated to the threaded segment and configured to compress the compression sleeve toward the shoulder of the unrecessed portion of the tool collar.

20 Claims, 9 Drawing Sheets

(56) References Cited

U.S. PATENT DOCUMENTS

2002/0153136 A1* 10/2002 Kruspe ..... G01V 3/32 166/250.01
2002/0163335 A1 11/2002 Prammer et al.
2004/0061622 A1* 4/2004 Clark ..... E21B 47/13 340/854.6
2007/0206555 A1* 9/2007 Kruspe ..... G01R 33/421 370/338
2007/0290689 A1* 12/2007 Sorbier ..... G01V 1/52 324/347
2008/0202742 A1* 8/2008 Hall ..... E21B 47/12 166/66
2008/0211687 A1* 9/2008 Price ..... E21B 17/028 340/854.3
2008/0230277 A1* 9/2008 Hall ..... E21B 47/01 175/325.1
2010/0018699 A1* 1/2010 Hall ..... E21B 17/042 166/242.6
2011/0108277 A1* 5/2011 Dudley ..... E21B 43/2405 166/308.1
2012/0180562 A1* 7/2012 Sorbier ..... G01V 3/18 73/152.02
2013/0000884 A1* 1/2013 Linklater ..... E21B 37/00 166/66.5
2013/0105222 A1* 5/2013 Pate ..... E21B 17/1014 175/40
2013/0134971 A1* 5/2013 Blanz ..... G01V 3/32 324/333
2013/0277114 A1* 10/2013 Hook ..... E21B 47/017 175/50
2017/0269252 A1 9/2017 Fang et al.
2018/0058201 A1* 3/2018 Zheng ..... E21B 47/017
2018/0252090 A1* 9/2018 Borg-Bartolo ..... E21B 47/001
2019/0153852 A1* 5/2019 Lallemand ..... E21B 47/12
2020/0217192 A1* 7/2020 Li ..... G01R 33/383
2020/0319367 A1* 10/2020 Xing ..... E21B 47/002
2020/0370415 A1* 11/2020 Das ..... E21B 17/042
2021/0208301 A1* 7/2021 Reiderman ..... G01R 33/44
2023/0021731 A1* 1/2023 Hanson ..... E21B 37/02
2023/0068555 A1* 3/2023 Chen ..... E21B 49/00

OTHER PUBLICATIONS

Chen, Songhua et al., "Magnetic resonance for downhole complexlithology earth formation evaluation", New Journal of Physics; 13 (2011) 085015 (14pp); Published Aug. 24, 2011; doi:10.1088/1367-2630/13/8/085015.

Magnisphere, high-defintion NMR logging-while-drilling service; Schulmberger; retrieved from slb.com/MagniSphere on Mar. 21, 2023.

International Search Report & Written Opinion; PCT Application No. PCT/US2023/016103; mailed Dec. 18, 2023.

* cited by examiner

COMPRESSION SLEEVE STRUCTURE FOR MOUNTING MAGNETS IN DOWNHOLE NUCLEAR MAGNETIC RESONANCE APPLICATION

TECHNICAL FIELD

The present technology pertains to securing magnets within a nuclear magnetic resonance ("NMR") tool in a manner that prevents damage or disturbance of the magnets due to the drilling environment, and more particularly, to creating a chamber within the structure of a logging while drilling ("LWD") tool to isolate the magnets from certain external conditions.

BACKGROUND

In the field of logging (e.g., wireline logging, logging while drilling ("LWD") and measurement while drilling ("MWD")), NMR tools have been used to explore the subsurface based on the magnetic interactions with subsurface material. Some downhole NMR tools include a magnet assembly that produces a static magnetic field, and a coil assembly that generates radio frequency ("RF") control signals and detects magnetic resonance phenomena in the subsurface material. Properties of the subsurface material can be identified from the detected phenomena.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
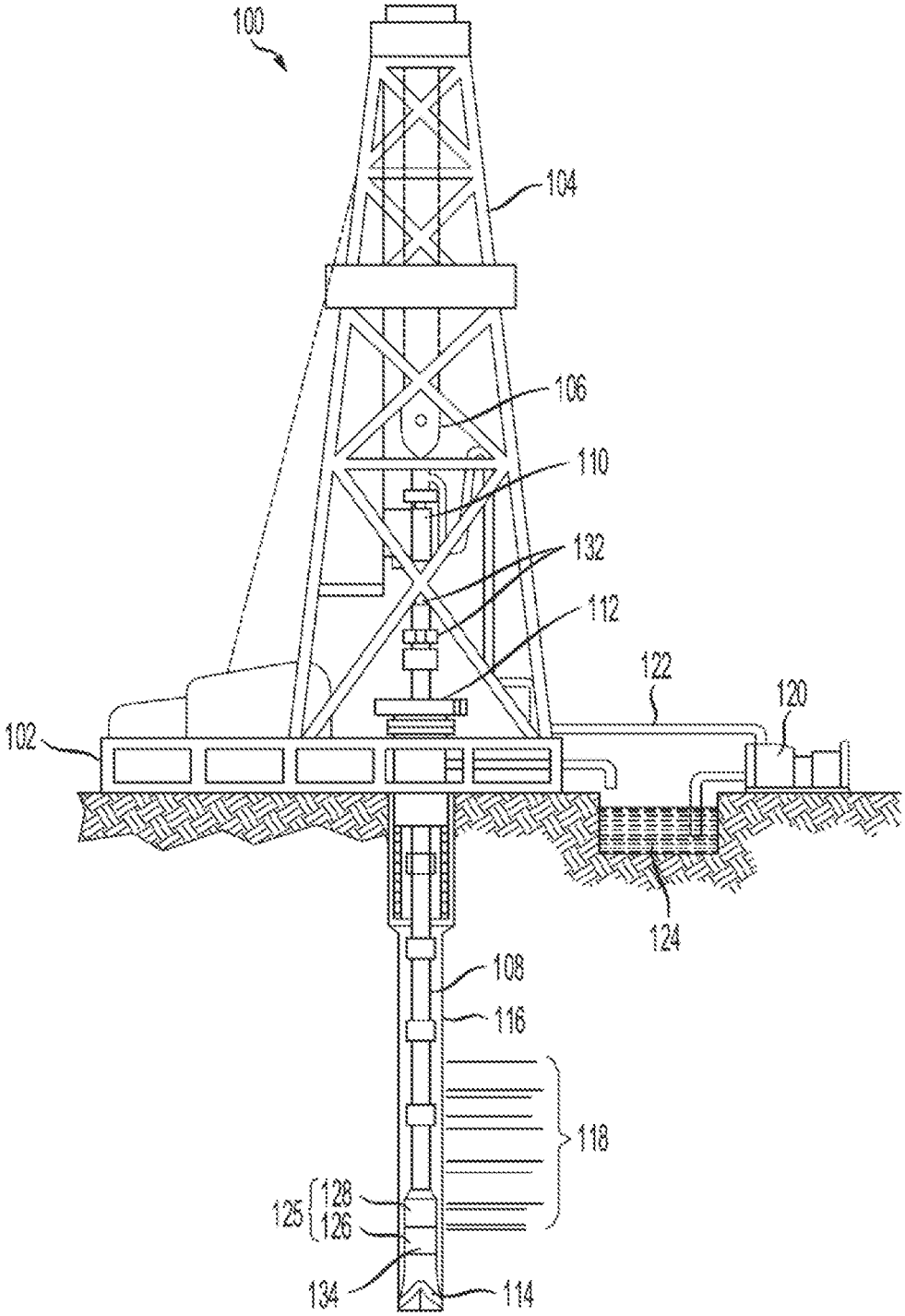
FIG. 1A is a schematic diagram of an example logging while drilling wellbore operating environment, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

As discussed previously, NMR tools have been used to explore the subsurface based on magnetic interactions with subsurface material. Some downhole NMR tools include a magnet assembly that produces a static magnetic field, and a coil assembly that generates radio frequency ("RF") control signals and detects magnetic resonance phenomena in the subsurface material. Properties of the subsurface material can be identified from the detected phenomena.

Magnets can be a critical component of NMR tools employed to detect magnetic resonance phenomena in subsurface material, and it can therefore be important that the magnets are protected from damage that can occur during these operations. In some examples, it can be critical that the magnets be secured in a manner that avoids damage to the magnets under potentially extreme downhole environmental conditions. For example, downhole environment conditions that can damage or disturb these magnets can include pressure, temperature, shock, vibration, and large, alternating flexure of the surrounding structure related to directional drilling, among other conditions. In some examples, mounting the magnets within the NMR tool can be challenging because magnets can have a low capacity to withstand tensile loading which can make them vulnerable to flexural conditions, among other problems. In some examples, magnets can also be substantial in size and mass and can therefore be difficult to restrain when subjected to these dynamic conditions, such as torsional shock. In some examples, successful NMR measurement can be sensitive to unanticipated changes in the state of the magnets. For example, when a magnet cracks or shifts, the result can be corruption to the system's calibration and/or harm to the final measurement.

Typically, magnets can be mounted to LWD collars by placing them into a carrier that is separate from the collar. In these examples, the collar and the carrier together can form a chamber that holds the magnets. This arrangement can be problematic because the structural connection between the carrier and the chamber can be vulnerable to downhole environmental conditions, such as attendant forces that translate through the collar assembly during tool operation/rotation. In some examples, this arrangement can leave the magnets vulnerable to dynamic conditions such as shock and vibration. In operation, this arrangement can lead to loosening of the magnet carrier's substructure, which compromises the magnet carrier thereby corrupting the measurements. In other examples, the magnets can be mounted to the outside of the collar and shielded by a metal sleeve. In these examples, the primary structure of the tool can be the drill collar itself while the surrounding parts (such as, for example, the metal sleeve) are secondary structures. Therefore, in these examples, the drill collar itself carries unwanted external loads (such as, for example, drilling torque). In other examples, the carrier can be composed of two separate sections that thread together. In these examples, the preload from this threaded connection can also be intended to anchor the carrier to the tool collar. However, dynamic downhole conditions such as vibration and torsional shock can loosen this connection thereby compromising the magnet carrier. Once the magnet carrier becomes compromised, the measurements can become corrupted.

Aspects of the disclosed technology provide solutions to the problems associated with these arrangements by combining the separate components in such a way as to form a structural assembly that shares all external loading, thereby relieving the magnets themselves from the load. As described in more detail below, this disclosed technology is an improvement because it couples the two parts which form the chamber in a rigid manner in a way that approximates a unibody structure. The magnets can still be placed into a separate carrier, but the disclosed technology enables the carrier to be connected to the primary structure optimally to withstand dynamic downhole conditions. In some examples, the chamber provided for the magnets can be pressure compensated via a hydraulic oil system in order to withstand the pressure associated with downhole conditions. In some examples, a chamber can be provided capable of withstanding downhole conditions such as hydrostatic pressure without the need for an additional pressure compensation system.

One solution to the above identified problems associated with using a carrier that is separate from the collar to hold the magnets can include creating a chamber within the structure of an LWD tool to isolate the magnets from certain external conditions (such as, for example, hydrostatic pressure and tool flexure) while securing the magnets and preventing subtle movement. In some examples, a drill collar can be fashioned into a mandrel covered by a separate heavy walled sleeve. The collar and sleeve can be coupled via the preload of a nearby rotary connection. This manner of coupling can be fundamental to the efficacy of this approach because rotary connection preloads can be very large. In some examples, a cavity suitable for locating carriers that hold the magnets securely can be placed within the sleeve and mandrel section of the tool collar. In some examples, anchor points can connect the carriers to the collar preventing axial movement, while compression of intermediate rubber layers between the collar, the carriers, and the outer sleeve can prevent lateral motion. In some examples, the combination of these arrangements can prevent torsional movement. In some examples, the components can be integrated by using the preload generated by an outer tool connection to provide the coupling mechanism because the preload can be orders of magnitude larger than preloads employed in previous configurations.

Turning now to FIG. 1A, a drilling arrangement is shown that exemplifies a Logging While Drilling (commonly abbreviated as LWD) configuration in a wellbore drilling scenario 100. Logging-While-Drilling typically incorporates sensors that acquire formation data. Specifically, the drilling arrangement shown in FIG. 1A can be used to gather formation data through an electromagnetic imager tool as part of logging the wellbore using the electromagnetic imager tool. The drilling arrangement of FIG. 1A also exemplifies what is referred to as Measurement While Drilling (commonly abbreviated as MWD) which utilizes sensors to acquire data from which the wellbore's path and position in three-dimensional space can be determined. FIG. 1A shows a drilling platform 102 equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, it creates a wellbore 116 that passes through various subterranean formations 118. A pump 120 circulates drilling fluid through a supply pipe 122 to top drive 110, down through the interior of drill string 108 and out orifices in drill bit 114 into the wellbore. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116. Various materials can be used for drilling fluid, including oil-based fluids and water-based fluids.

Logging tools 126 can be integrated into the bottom-hole assembly 125 near the drill bit 114. As the both drill bit 114 extends into the wellbore 116 through the formations 118 and as the drill string 108 is pulled out of the wellbore 116, logging tools 126 collect measurements relating to various formation properties as well as the orientation of the tool and various other drilling conditions. The logging tool 126 can be applicable tools for collecting measurements in a drilling scenario, such as the nuclear magnetic resonance ("NMR") tools described herein. Each of the logging tools 126 may include one or more tool components spaced apart from each other and communicatively coupled by one or more wires and/or other communication arrangement. The logging tools 126 may also include one or more computing devices communicatively coupled with one or more of the tool components. The one or more computing devices may be configured to control or monitor a performance of the tool, process logging data, and/or carry out one or more aspects of the methods and processes of the present disclosure.

The bottom-hole assembly 125 may also include a telemetry sub 128 to transfer measurement data to a surface receiver 132 and to receive commands from the surface. In at least some cases, the telemetry sub 128 communicates with a surface receiver 132 by wireless signal transmission. e.g, using mud pulse telemetry, EM telemetry, or acoustic telemetry. In other cases, one or more of the logging tools 126 may communicate with a surface receiver 132 by a wire, such as wired drill pipe. In some instances, the telemetry sub 128 does not communicate with the surface, but rather stores logging data for later retrieval at the surface when the logging assembly is recovered. In at least some cases, one or more of the logging tools 126 may receive electrical power from a wire that extends to the surface, including wires extending through a wired drill pipe. In other cases, power is provided from one or more batteries or via power generated downhole.

Collar 134 is a frequent component of a drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

Figure 1B:
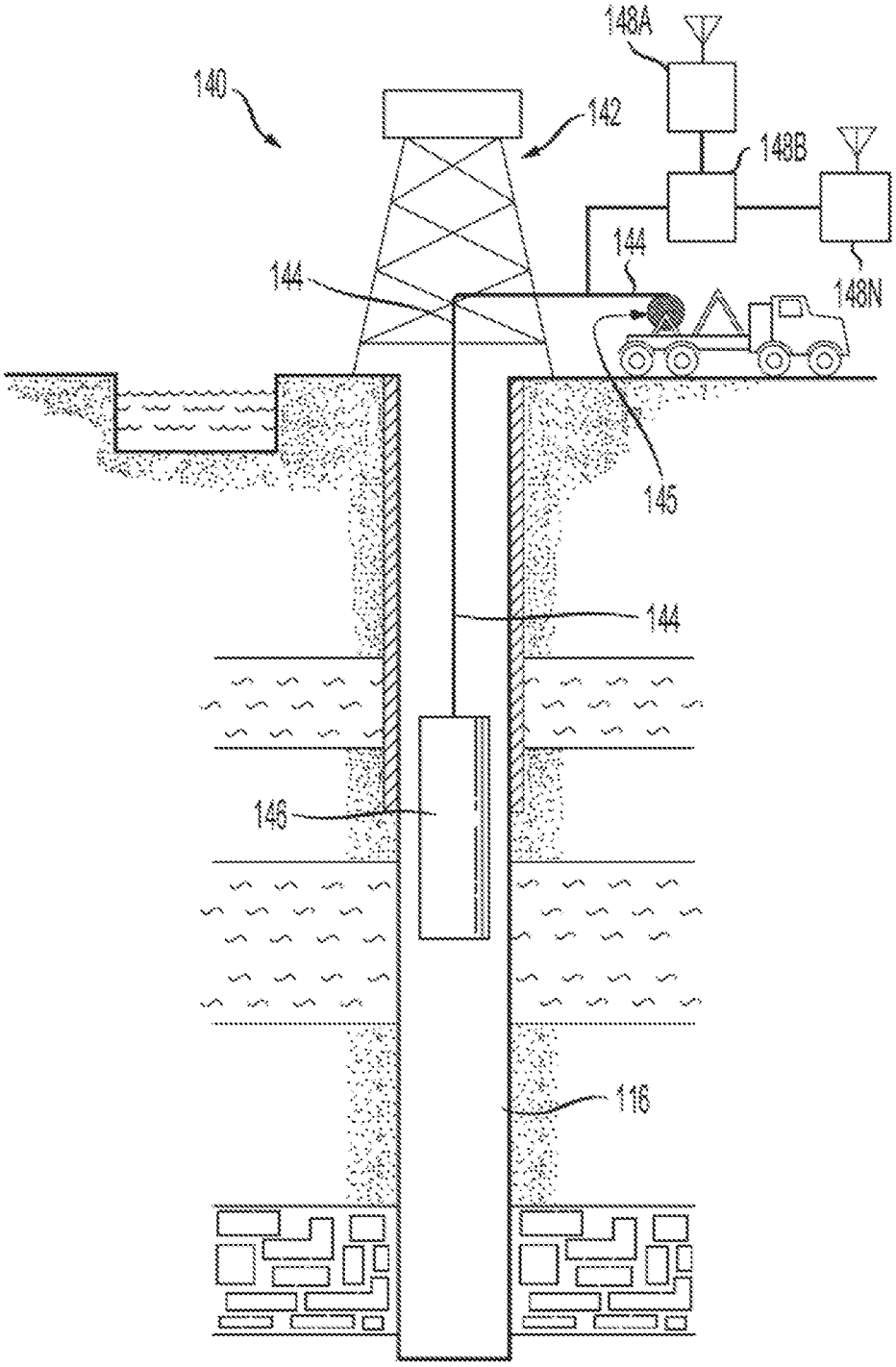
FIG. 1B is a schematic diagram of an example downhole environment having tubulars, in accordance with various aspects of the subject technology.

Referring to FIG. 1B, an example system 140 is depicted for conducting downhole measurements after at least a portion of a wellbore has been drilled and the drill string removed from the well. A downhole tool can be operated in the example system 140 shown in FIG. 1B to log the wellbore. A downhole tool is shown having a tool body 146 in order to carry out logging and/or other operations. For example, instead of using the drill string 108 of FIG. 1A to lower the downhole tool, which can contain sensors and/or other instrumentation for detecting and logging nearby characteristics and conditions of the wellbore 116 and surrounding formations, a wireline conveyance 144 can be used. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars. The downhole tool can include an applicable tool for collecting measurements in a drilling scenario, such as the nuclear magnetic resonance ("NMR") tools described herein.

The illustrated wireline conveyance 144 provides power and support for the tool, as well as enabling communication between data processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more of the processors 148A-N, which can include local and/or remote processors. The processors 148A-N can be integrated as part of an applicable computing system, such as the computing device architectures described herein. Moreover, power can be supplied via the wireline conveyance 144 to meet power requirements of the tool. For slickline or coiled tubing configurations, power can be supplied downhole with a battery or via a downhole generator.

Figure 2:
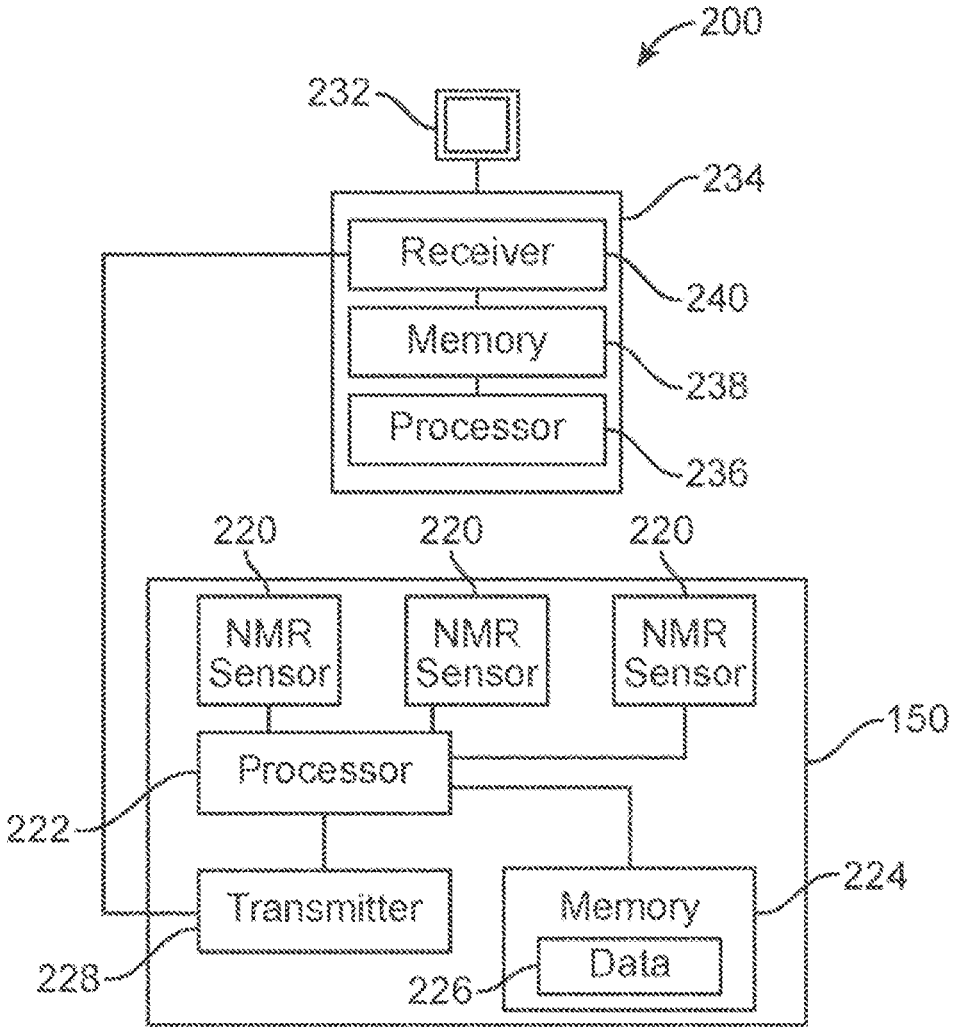
FIG. 2 illustrates an example nuclear magnetic resonance ("NMR") apparatus, in accordance with various aspects of the subject technology.

FIG. 2 illustrates an example NMR apparatus 200. The example NMR apparatus shown in FIG. 2 can be implemented in an applicable environment, such as the LWD environment shown in FIG. 1A and the wireline environment shown in FIG. 1B. As shown in FIG. 2, the NMR apparatus 200 may include an NMR data acquisition tool 150 communicatively coupled to an NMR data processing unit 234. The NMR data acquisition tool 150 may include one or more NMR sensors 220 communicatively coupled to an NMR data acquisition processor 222. The NMR data acquisition tool 150 may further include data acquisition memory 224 capable of storing instructions that when executed by the data acquisition processor 222 causes the data acquisition processor 222 to acquire NMR data in a time domain from a subterranean formation, or core sample therefrom, using one or more NMR sensors 220. The data acquisition memory 224 is also capable of storing acquired NMR data 226.

The NMR data acquisition processor 222 may optionally be communicatively coupled to a transmitter 228 capable of transmitting the acquired NMR data 226 to the NMR data processing unit 234.

The NMR data processing unit 234 can include a data processor 236 communicatively coupled to data processing memory 238 capable of storing instructions that when executed by the data processor 236 causes the data processor 236 to receive the NMR data 226 from the NMR data acquisition tool 150. The NMR data processing unit 234 may optionally have a receiver 240 capable of receiving NMR data 226 from the transmitter 228 of the NMR data acquisition tool 150. The NMR data processing unit 234 may also optionally have a display 232 capable of displaying results generated based on the NMR data 226.

Figure 3:
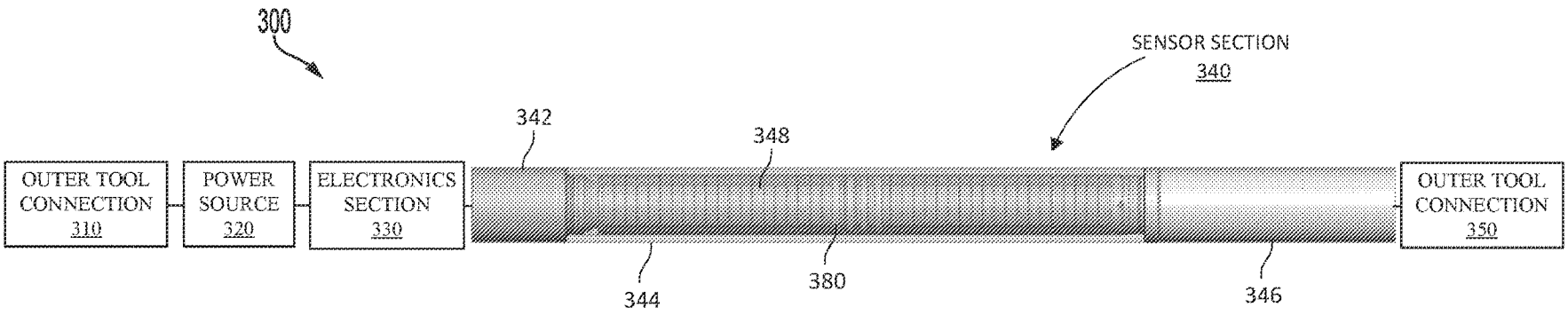
FIG. 3 illustrates a perspective view of an example nuclear magnetic resonance ("NMR") tool, in accordance with various aspects of the subject technology.

FIG. 3 is a perspective view of an example nuclear magnetic resonance ("NMR") tool 300. The example NMR tool 300 shown in FIG. 3 can be implemented in an applicable environment, such as the LWD environment shown in FIG. 1A, and the wireline environment shown in FIG. 1B.

In the example illustrated in FIG. 3, NMR tool 300 can carry one or more large magnets in such a way that the magnets are secured and impervious to damage or disturbances related to the drilling environment. In some examples, NMR tool 300 can include, at minimum, a sensor section 340 comprising an antenna 380 positioned over the one or more magnets 348. In some examples, the combined antenna 380 and magnets 348 can represent the sensor section 340 of the downhole NMR tool 300. In some examples, a complete NMR tool 300 assembly can include an electronics section 330, a power source 320, and outer tool connections 310 and 350, which enable the NMR tool 300 to connect electrically and mechanically to other components in the Bottom Hole Assembly (BHA). Other components of the NMR tool 300 can include a tool collar 342, a compression sleeve 344, a compression sub 346, and a secondary structure or structures that contain the magnets 348 (e.g., a magnet carrier, located beneath magnets 348 in FIG. 3).

Figure 4A:
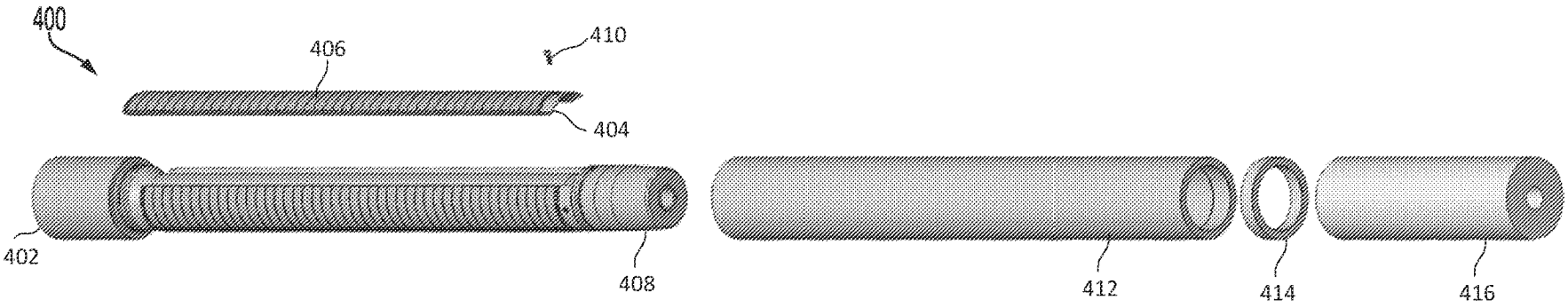
FIG. 4A illustrates an exploded side perspective view of an NMR tool sensor section, in accordance with various aspects of the subject technology.

FIG. 4A illustrates an exploded side perspective view of the NMR tool sensor section 340 shown in FIG. 3. Similar to FIG. 3, the NMR tool sensor section 400 illustrated in FIG. 4A includes a tool collar 402, a compression sleeve 412, a compression sub 416, and a magnet carrier 404 that contains the magnets 406. Also illustrated in FIG. 4A are fastener 410, optional bearing ring 414, and threaded rotary connection 408. In some examples, a critical feature of the design illustrated in FIG. 4A can be the threaded rotary connection 408 where the compression sub 416 and the tool collar connect. In some examples, the preload generated by the rotary connection 408 can be transmitted from the compression sub 416 through the compression sleeve 412 into the tool collar 402. This preload can be sufficiently large enough to couple the tool collar 402, compression sleeve 415, and compression sub 416 into a near-unibody state. In this arrangement, magnets 406 can be protected from unwanted downhole conditions that can damage the magnets as discussed above.

Figure 4B:
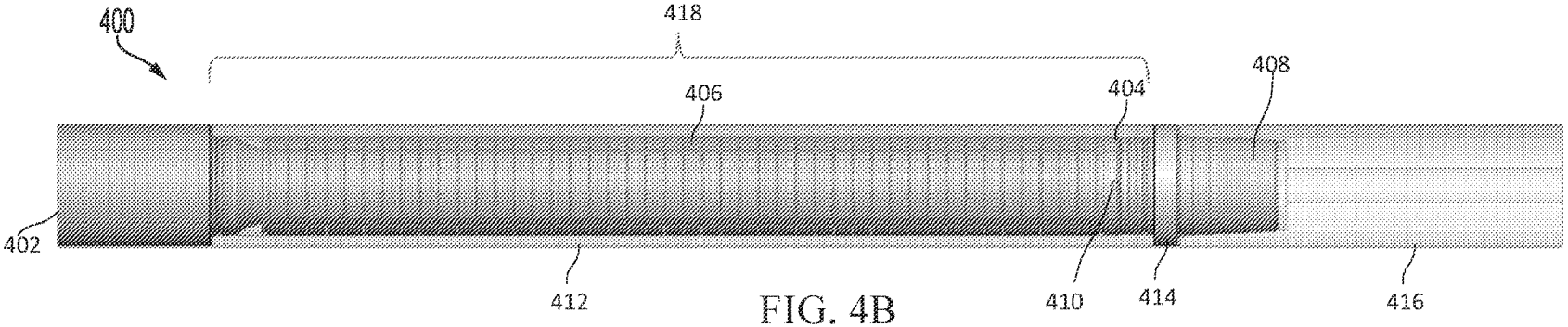
FIG. 4B illustrates an assembled side perspective view of the NMR tool sensor section, in accordance with various aspects of the subject technology.

FIG. 4B shows an assembled side perspective view of the NMR tool sensor section 400 shown in FIG. 4A. Similar to FIG. 4A, the NMR tool sensor section 400 illustrated in FIG. 4B also includes a tool collar 402, a compression sleeve 412, a compression sub 416, and a magnet carrier 404 that contains the magnets 406, which have all been assembled according to one embodiment of the present disclosure. Also illustrated in FIG. 4B are fastener 410, optional bearing ring 414, and threaded rotary connection 408. As illustrated in FIG. 4B, in some examples, a region of the tool collar 402 beneath the compression sleeve 412 can be shaped in such a way as to form a cavity between the tool collar 402 and the compression sleeve 412. In some examples, this cavity can be the magnet chamber. In some examples, the portion of the tool collar 402 that has been shaped in this way can be called the collar mandrel section 418. As shown in FIG. 4B, once assembled, magnets 406 can be protected from unwanted downhole conditions that can damage the magnets as discussed above.

Figure 5:
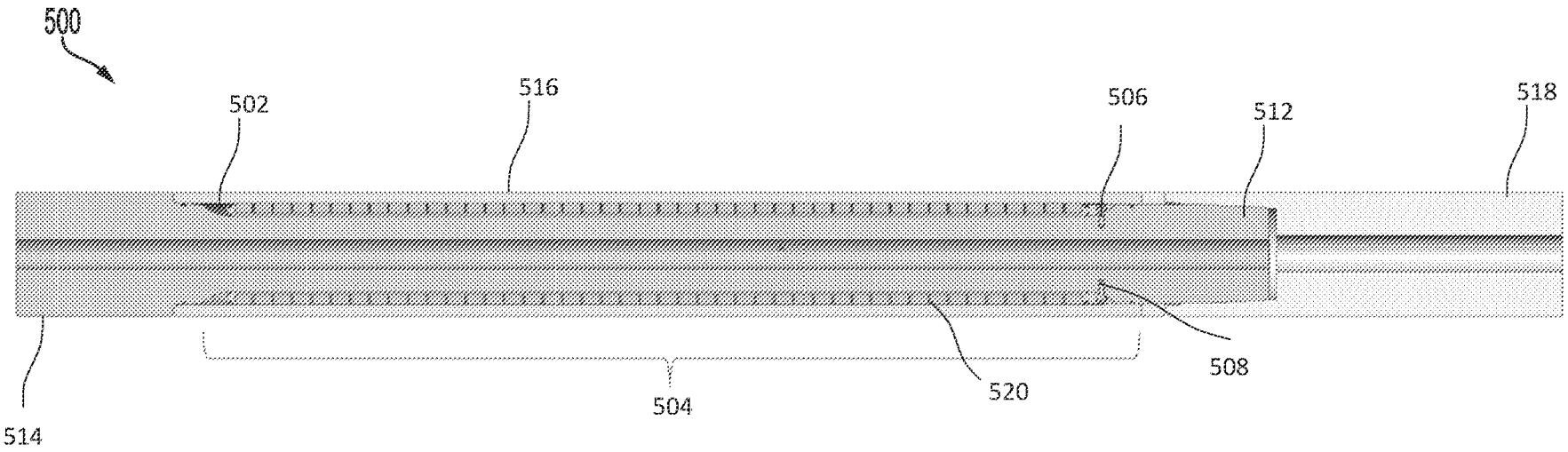
FIG. 5 illustrates a side perspective view of an NMR tool sensor section, in accordance with various aspects of the subject technology.

FIG. 5 illustrates a side perspective view of an NMR tool sensor section 500. As illustrated in FIG. 5, anchor points 506 and 508, located in the magnet chamber 502, can be used to attach the magnet carrier 520 to the tool collar 514. In some examples, the tool collar 514, the compression sleeve 516, and the compression sub 518 can be manufactured conventionally by machine shops using materials typical for this application. In some cases, the assembly step of inserting the magnet carriers 520 into the tool collar 514 can require an outside vendor who specializes in working with powerful magnets, a typical practice in NMR tool assembly. FIG. 5 illustrates that in some examples, the collar mandrel section 504 can include the magnet chamber 502 containing magnet carrier 520 that secures the magnets and further protects them from unwanted downhole conditions. In some examples, a critical feature of the design illustrated in FIG. 5 can be the threaded rotary connection 512 where the compression sub 518 and the tool collar connect. In some examples, the preload generated by the rotary connection 512 can be transmitted from the compression sub 518 through the compression sleeve 516 into the tool collar 514, thereby avoiding strain on the magnets themselves. This preload can be sufficiently large enough to couple the tool collar 514, compression sleeve 516, and compression sub 518 into a near-unibody state. In the example illustrated in FIG. 5, the array of magnet carriers 520 can be located circumferentially around the tool collar 514 in the collar mandrel section 504. Each magnet carrier 520 can be anchored to the tool collar 514 at one or more locations via mechanical fasteners located at anchor points 506 and 508.

Figure 6:
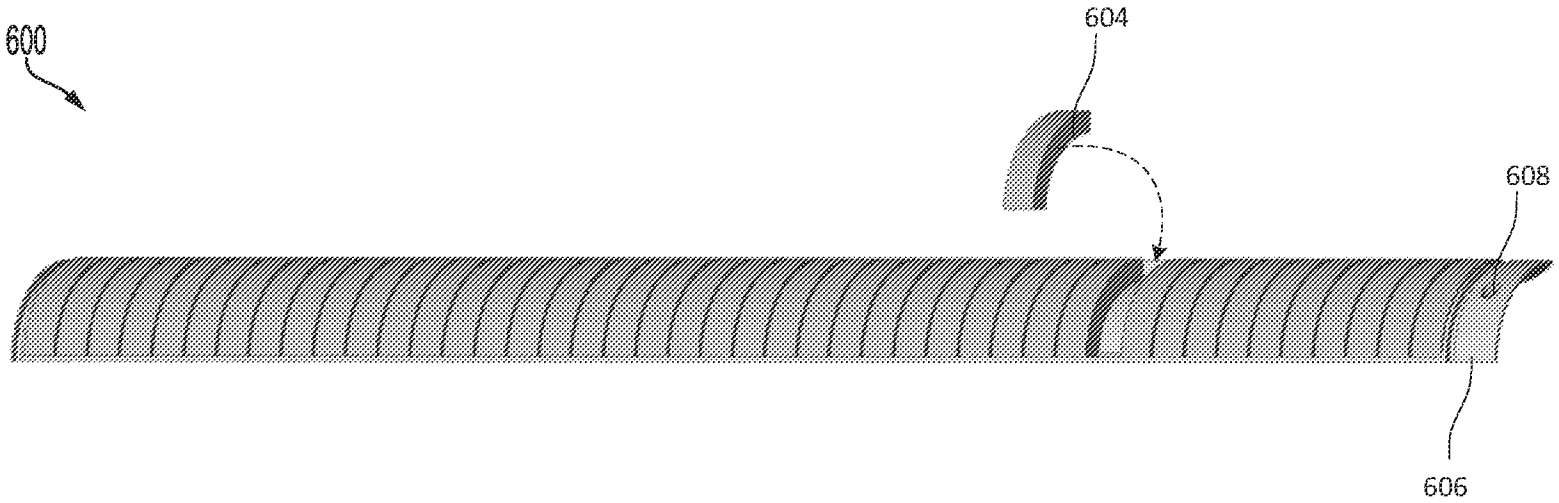
FIG. 6 illustrates a perspective view of an example magnet carrier, in accordance with various aspects of the subject technology.

FIG. 6 illustrates a perspective view of an example magnet carrier 600. As illustrated in FIG. 6, magnet carrier 600 can include a carrier body 606 for securing magnets 604 as well as an anchor point 608 that can be used to secure the magnet carrier 600 to the tool collar. As discussed with respect to the previous figures, the tool collar can include an array of magnet carriers 600 secured circumferentially around the tool collar in the collar mandrel section. As illustrated in FIG. 6, each magnet carrier 600 can be anchored to the tool collar at one or more locations (e.g., anchor point 608) via mechanical fasteners. Additionally, in some embodiments, the magnet carrier 600 can be constrained from lateral movement by including compressed rubber components (not shown), energized by the compression sleeve and the tool collar. In these examples, the magnet carrier 600 can be comprised of a carrier body 606 that receives a linear array of magnets 604. The carrier body 606 and magnets 604 can be connected using epoxy, for example, but can also be connected by mechanical fasteners, or any other known technique.

In some embodiments, the compression sleeve magnet carrier can also be used without an antenna. Alternatively, two magnet collars can be combined with a separate antenna collar to form the sensor section of an NMR tool. Additionally, the structure for containing the magnets can be integrated into the tool collar in some embodiments. It is contemplated that pockets can be milled into the tool collar's mandrel section, or the magnets can be bonded to the mandrel area using epoxy. In some embodiments, the magnets can also be encapsulated within a volume of material such as fiberglass that is bonded to the tool collar.

Figure 7:
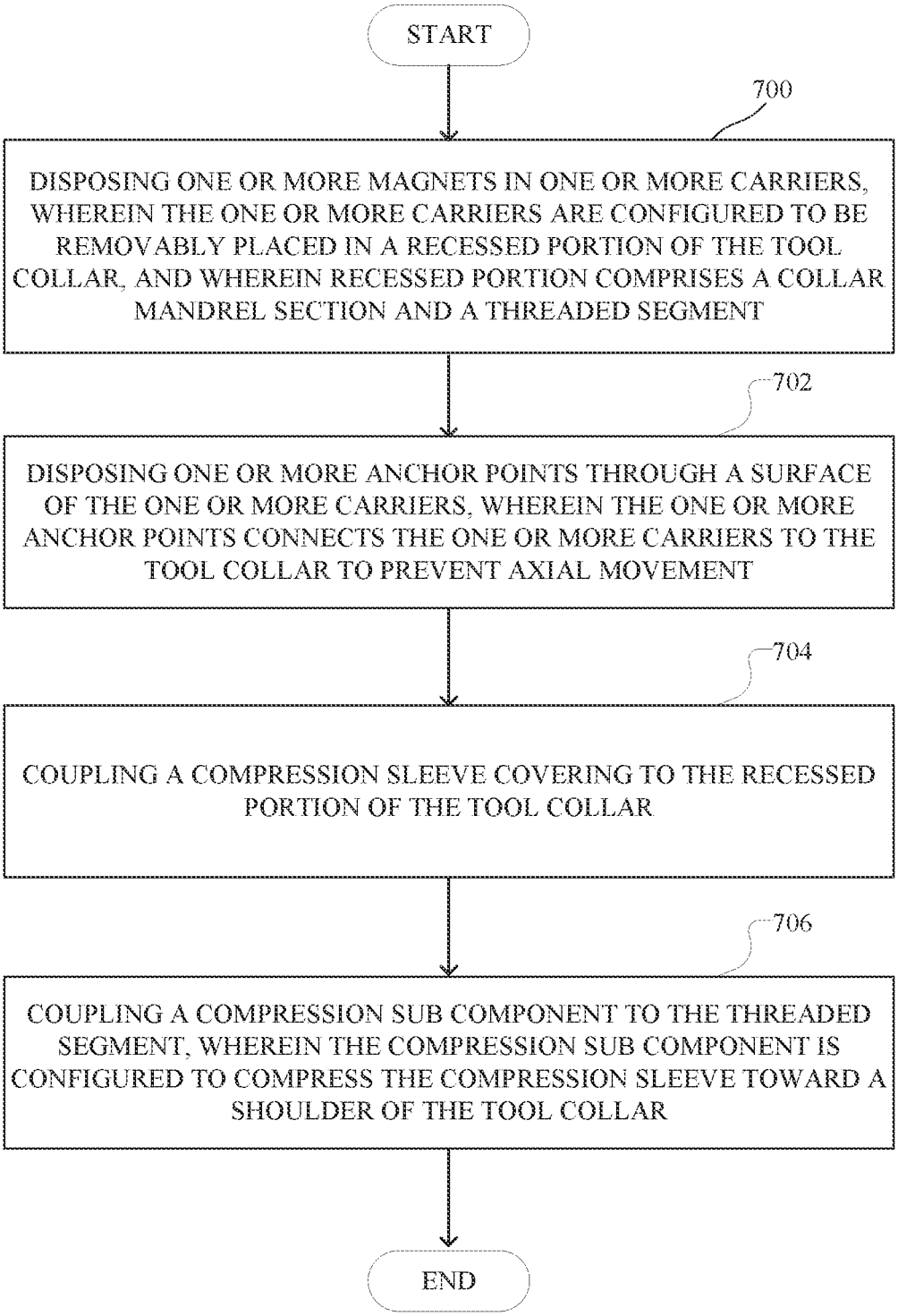
FIG. 7 illustrates a flow diagram showing an example method of manufacturing a tool collar, in accordance with various aspects of the subject technology.

FIG. 7 is a flow diagram illustrating an example method of manufacturing a tool collar. The operations of the method presented below are intended to be illustrative. In some implementations, various embodiments may be accomplished with one or more additional operations not described and/or without one or more of the operations discussed. Additionally, the order in which the operations are illustrated in FIG. 7 and described below is not intended to be limiting and may be performed in different orders.

At operation 700, the method can include disposing one or more magnets in one or more carriers, wherein the one or more carriers are configured to be removably placed in a recessed portion of the tool collar, and wherein recessed portion comprises a collar mandrel section and a threaded segment. For example, the magnet carrier assembly and the magnets can be connected using epoxy. Alternatively, the magnet carrier assembly and the magnets can be connected by mechanical fasteners, or any other known technique. At operation 702, the method can include disposing one or more anchor points through a surface of the one or more carriers, wherein the one or more anchor points connects the one or more carriers to the tool collar to prevent axial movement. For example, an array of magnet carrier assemblies can be located circumferentially around the tool collar in the component mandrel section of the tool collar. In some examples, each magnet carrier assembly can be anchored to the tool collar at one or more locations via mechanical fasteners. At operation 704, the method can include coupling a compression sleeve covering to the recessed portion of the tool collar. At operation 706, the method can include coupling a compression sub component to the threaded segment, wherein the compression sub component is configured to compress the compression sleeve toward a shoulder of the tool collar. In some examples, the collar and sleeve can be coupled via the preload of the rotary connection. In some examples, this method of coupling can be fundamental to the efficacy of this approach. Rotary connection preloads can be enormous and therefore employing them in this way can join the collar and sleeve into a near-unibody state. Within the sleeve and mandrel section of the collar is a cavity suitable for locating carriers that hold the magnets securely. Anchor points connect the carriers to the collar and can prevent axial movement, while compression of intermediate rubber layers between the collar, the carriers, and the outer sleeve can prevent lateral motion. The combination of these methods can prevent torsional movement and ultimately protect the magnets from unwanted damage.

Figure 8:
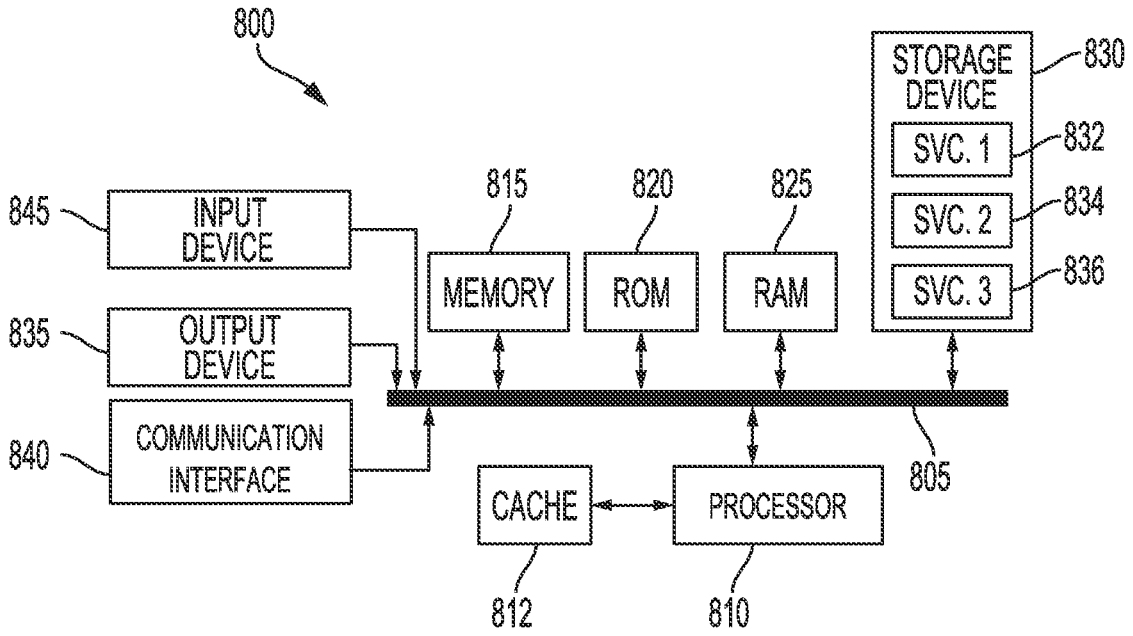
FIG. 8 illustrates an example computing device architecture which can be employed to perform various steps, methods, and techniques disclosed herein, in accordance with various aspects of the subject technology.

FIG. 8 illustrates an example computing device architecture 800 which can be employed to perform various steps, methods, and techniques disclosed herein. Specifically, the computing device architecture can be integrated with the electromagnetic imager tools described herein. Further, the computing device can be configured to implement the techniques of controlling borehole image blending through machine learning described herein.

As noted above, FIG. 8 illustrates an example computing device architecture 800 of a computing device which can implement the various technologies and techniques described herein. The components of the computing device architecture 800 are shown in electrical communication with each other using a connection 805, such as a bus. The example computing device architecture 800 includes a processing unit (CPU or processor) 810 and a computing device connection 805 that couples various computing device components including the computing device memory 815, such as read only memory (ROM) 820 and random access memory (RAM) 825, to the processor 810.

The computing device architecture 800 can include a cache of high-speed memory connected directly with, in close proximity to, or integrated as part of the processor 810. The computing device architecture 800 can copy data from the memory 815 and/or the storage device 830 to the cache 812 for quick access by the processor 810. In this way, the cache can provide a performance boost that avoids processor 810 delays while waiting for data. These and other modules can control or be configured to control the processor 810 to perform various actions. Other computing device memory 815 may be available for use as well. The memory 815 can include multiple different types of memory with different performance characteristics. The processor 810 can include any general purpose processor and a hardware or software service, such as service 1 832, service 2 834, and service 3 836 stored in storage device 830, configured to control the processor 810 as well as a special-purpose processor where software instructions are incorporated into the processor design. The processor 810 may be a self-contained system, containing multiple cores or processors, a bus, memory controller, cache, etc. A multi-core processor may be symmetric or asymmetric.

To enable user interaction with the computing device architecture 800, an input device 845 can represent any number of input mechanisms, such as a microphone for speech, a touch-sensitive screen for gesture or graphical input, keyboard, mouse, motion input, speech and so forth. An output device 835 can also be one or more of a number of output mechanisms known to those of skill in the art, such as a display, projector, television, speaker device, etc. In some instances, multimodal computing devices can enable a user to provide multiple types of input to communicate with the computing device architecture 800. The communications interface 840 can generally govern and manage the user input and computing device output. There is no restriction on operating on any particular hardware arrangement and therefore the basic features here may easily be substituted for improved hardware or firmware arrangements as they are developed.

Storage device 830 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 825, read only memory (ROM) 820, and hybrids thereof. The storage device 830 can include services 832, 834, 836 for controlling the processor 810. Other hardware or software modules are contemplated. The storage device 830 can be connected to the computing device connection 805. In one aspect, a hardware module that performs a particular function can include the software component stored in a computer-readable medium in connection with the necessary hardware components, such as the processor 810, connection 805, output device 835, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the Disclosure Include:

Statement 1. A downhole tool comprising: a tool collar with a recessed portion comprising a collar mandrel section and a threaded segment, wherein the recessed portion of the tool collar comprises at least one cavity configured to accept one or more carriers configured to hold one or more magnets, wherein the tool collar with an unrecessed portion comprises a shoulder proximate to the recessed portion of the tool collar; one or more anchor points disposed through a surface of the one or more carriers that connects the one or more carriers to the tool collar preventing axial movement; a compression sleeve covering the recessed portion and the at least one cavity of the downhole tool; and a compression sub component mated to the threaded segment and configured to compress the compression sleeve toward the shoulder of the unrecessed portion of the tool collar.

Statement 2. The downhole tool of statement 1, further comprising an antenna positioned over the magnets.

Statement 3. The downhole tool of any of statements 1 and 2, further comprising at least one of an electronics section, a power source, and an outer tool connection.

Statement 4. The downhole tool of any of statements 1 through 3, wherein the one or more carriers are located circumferentially around the tool collar in the collar mandrel section.

Statement 5. The downhole tool of statement 4, wherein the one or more carriers are anchored to the tool collar at one or more locations via mechanical fasteners.

Statement 6. The downhole tool of any of statements 1 through 5, further comprising one or more rubber components to constrain the one or more carriers from lateral movement.

Statement 7. The downhole tool of any of statements 1 through 6, wherein the one or more carriers hold the one or more magnets securely using at least one or epoxy and mechanical fasteners.

Statement 8. The downhole tool of any of statements 1 through 7, further comprising one or more bearing rings positioned between the compression sleeve and the compression sub.

Statement 9. The downhole tool of any of statements 1 through 8, wherein the threaded segment is tapered.

Statement 10. The downhole tool of statement 3, wherein the electronics section includes at least one of a printed circuit boards (PCB), a sensor, or a power system.

Statement 11. A tool collar comprising: a recessed portion comprising a collar mandrel section and a threaded segment, wherein the recessed portion of the tool collar comprises at least one cavity configured to accept one or more carriers configured to hold one or more magnets; an unrecessed portion comprising a shoulder proximate to the recessed portion of the tool collar; one or more anchor points disposed through a surface of the one or more carriers that connects the one or more carriers to the tool collar preventing axial movement; a compression sleeve covering the recessed portion and the at least one cavity of the tool collar; and a compression sub component mated to the threaded segment and configured to compress the compression sleeve toward the shoulder of the unrecessed portion of the tool collar.

Statement 12. The tool collar of statement 11, further comprising an antenna positioned over the magnets.

Statement 13. The tool collar of any of statements 11 and 12, further comprising at least one of an electronics section, a power source, and an outer tool connection.

Statement 14. The tool collar of any of statements 11 through 13, wherein the one or more carriers are located circumferentially around the tool collar in the collar mandrel section.

Statement 15. The tool collar of statement 14, wherein the one or more carriers are anchored to the tool collar at one or more locations via mechanical fasteners.

Statement 16. The tool collar of any of statements 11 through 15, further comprising one or more rubber components to constrain the one or more carriers from lateral movement.

Statement 17. The tool collar of any of statements 11 through 16, wherein the one or more carriers hold the one or more magnets securely using at least one or epoxy and mechanical fasteners.

Statement 18. The tool collar of any of statements 11 through 17, further comprising one or more bearing rings positioned between the compression sleeve and the compression sub.

Statement 19. The tool collar of any of statements 11 through 18, wherein the threaded segment is tapered.

Statement 20. A method of manufacturing a tool collar comprising: disposing one or more magnets in one or more carriers, wherein the one or more carriers are configured to be removably placed in a recessed portion of the tool collar, and wherein recessed portion comprises a collar mandrel section and a threaded segment; disposing one or more anchor points through a surface of the one or more carriers, wherein the one or more anchor points connects the one or more carriers to the tool collar to prevent axial movement; coupling a compression sleeve covering to the recessed portion of the tool collar; and coupling a compression sub component to the threaded segment, wherein the compression sub component is configured to compress the compression sleeve toward a shoulder of the tool collar.

What is claimed is:

1. A downhole tool comprising:

a tool collar with a recessed portion comprising a collar mandrel section and a threaded segment, wherein the recessed portion of the tool collar comprises at least one cavity having one or more carriers holding one or more magnets, wherein the tool collar with an unrecessed portion comprises a shoulder proximate to the recessed portion of the tool collar;

one or more anchor points disposed through a surface of the one or more carriers that connects the one or more carriers to the tool collar preventing axial movement;

a compression sleeve covering the recessed portion and the at least one cavity of the downhole tool; and a compression sub component mated to the threaded segment and configured to compress the compression sleeve toward the shoulder of the unrecessed portion of the tool collar.

2. The downhole tool of claim 1, further comprising an antenna positioned over the one or more magnets.

3. The downhole tool of claim 1, further comprising at least one of an electronics section, a power source, and an outer tool connection.

4. The downhole tool of claim 3, wherein the electronics section includes at least one of a printed circuit boards (PCB), a sensor, or a power system.

5. The downhole tool of claim 1, wherein the one or more carriers are located circumferentially around the tool collar in the collar mandrel section.

6. The downhole tool of claim 5, wherein the one or more carriers are anchored to the tool collar at one or more locations via mechanical fasteners.

7. The downhole tool of claim 1, further comprising one or more rubber components to constrain the one or more carriers from lateral movement.

8. The downhole tool of claim 1, wherein the one or more carriers hold the one or more magnets securely using at least one or epoxy and mechanical fasteners.

9. The downhole tool of claim 1, further comprising one or more bearing rings positioned between the compression sleeve and the compression sub component.

10. The downhole tool of claim 1, wherein the threaded segment is tapered.

11. A tool collar comprising:

a recessed portion comprising a collar mandrel section and a threaded segment, wherein the recessed portion of the tool collar comprises at least one cavity having one or more carriers holding one or more magnets;

an unrecessed portion comprising a shoulder proximate to the recessed portion of the tool collar;

one or more anchor points disposed through a surface of the one or more carriers that connects the one or more carriers to the tool collar preventing axial movement;

a compression sleeve covering the recessed portion and the at least one cavity of the tool collar; and a compression sub component mated to the threaded segment and configured to compress the compression sleeve toward the shoulder of the unrecessed portion of the tool collar.

12. The tool collar of claim 11, further comprising an antenna positioned over the one or more magnets.

13. The tool collar of claim 11, further comprising at least one of an electronics section, a power source, and an outer tool connection.

14. The tool collar of claim 11, wherein the one or more carriers are located circumferentially around the tool collar in the collar mandrel section.

15. The tool collar of claim 14, wherein the one or more carriers are anchored to the tool collar at one or more locations via mechanical fasteners.

16. The tool collar of claim 11, further comprising one or more rubber components to constrain the one or more carriers from lateral movement.

17. The tool collar of claim 11, wherein the one or more carriers hold the one or more magnets securely using at least one or epoxy and mechanical fasteners.

18. The tool collar of claim 11, further comprising one or more bearing rings positioned between the compression sleeve and the compression sub component.

19. The tool collar of claim 11, wherein the threaded segment is tapered.

20. A method of manufacturing a tool collar comprising:

disposing one or more magnets in one or more carriers, wherein the one or more carriers are configured to be removably placed in a recessed portion of the tool collar, and wherein the recessed portion comprises a collar mandrel section and a threaded segment;

disposing one or more anchor points through a surface of the one or more carriers, wherein the one or more anchor points connects the one or more carriers to the tool collar to prevent axial movement;

coupling a compression sleeve covering to the recessed portion of the tool collar; and coupling a compression sub component to the threaded segment, wherein the compression sub component is configured to compress the compression sleeve toward a shoulder of the tool collar.

* * * * *